US008519327B2

(12) United States Patent
Izumi

(10) Patent No.: US 8,519,327 B2
(45) Date of Patent: Aug. 27, 2013

(54) MASS SPECTROMETER

(75) Inventor: Hideaki Izumi, Neyagawa (JP)

(73) Assignee: Shimadzu Corporation, Kyoto-Shi (JP)

( * ) Notice: Subject to any disclaimer, the term of this patent is extended or adjusted under 35 U.S.C. 154(b) by 0 days.

(21) Appl. No.: 13/380,440

(22) PCT Filed: Jun. 22, 2009

(86) PCT No.: PCT/JP2009/002822

§ 371 (c)(1),
(2), (4) Date: Jan. 31, 2012

(87) PCT Pub. No.: WO2010/150301

PCT Pub. Date: Dec. 29, 2010

(65) Prior Publication Data

US 2012/0175514 A1 Jul. 12, 2012

(51) Int. Cl.
*H01J 49/26* (2006.01)

(52) U.S. Cl.
USPC ..... 250/281; 250/282; 250/283; 250/286; 250/287; 250/397

(58) Field of Classification Search
USPC ..... 250/281, 282, 283, 286, 287, 396 R, 250/397
See application file for complete search history.

(56) References Cited

U.S. PATENT DOCUMENTS

| | | | | |
|---|---|---|---|---|
| 4,330,731 | A | 5/1982 | Garin et al. | |
| 6,373,067 | B1 * | 4/2002 | Shimomura | 250/397 |
| 7,855,355 | B2 | 12/2010 | Mizutani | |
| 2004/0016867 | A1 * | 1/2004 | Milshtein et al. | 250/207 |

FOREIGN PATENT DOCUMENTS

| | | | |
|---|---|---|---|
| DE | 10029030 | A1 | 12/2000 |
| EP | 0018253 | A2 | 10/1980 |
| JP | 55137654 | A | 10/1980 |
| JP | 2000357487 | A | 12/2000 |
| JP | 2005276488 | A | 10/2005 |
| WO | 2007029327 | A1 | 3/2007 |

OTHER PUBLICATIONS

International preliminary report on patentability dated Jan. 17, 2012 and its English language translation issued in corresponding PCT application PCT/JP2009/002822 cites the foreign patent documents above.

* cited by examiner

*Primary Examiner* — Michael Logie
(74) *Attorney, Agent, or Firm* — Bingham McCutchen LLP

(57) ABSTRACT

In an ion detector, power supplies (21 through 23) generating independently controllable voltages are provided to respectively apply voltages to first to fifth dynodes (11 through 15), a final dynode (16), and an anode (17) in a secondary electron multiplier (10). Furthermore, the signal from the anode (17) is extracted, and the signal from the fifth dynode (15), which has a low electron multiplication rate, is extracted. These two signals are concurrently converted into digital values, taken in by a data processing unit (34), and stored in a data storage unit (35). When a mass spectrum is created in the data processing unit (34), the two detected data for the same time are read out and the presence or absence of signal saturation or waveform deformation is determined from the values of one of the detection data. If there is a high probability of signal saturation, the detection data based on the signals in the intermediate stages are selected, and the level of the selected data is corrected. The application of independent voltages to the secondary electron multiplier (10) makes the signal saturation less likely to occur. Even if saturation temporarily occurs, an unsaturated signal can be reflected in the mass spectrum.

14 Claims, 2 Drawing Sheets

MASS SPECTROMETER

CROSS-REFERENCE TO THE RELATED APPLICATIONS

This application is a national stage of international application No. PCT/JP2009/002822, filed on Jun. 22, 2009, the entire content of which is incorporated herein by reference.

TECHNICAL FIELD

The present invention relates to a mass spectrometer. In particular, it relates to a mass spectrometer in which an electron multiplier detector is used as an ion detector.

BACKGROUND ART

In a mass spectrometer, ions separated in accordance with their mass-to-charge ratio m/z in a mass separator are detected in an ion detector. In general, in an ion detector, a signal proportional to the number of received ions is read out. In particular, in a quantitative analysis, it is important that the range of the amount of detectable ions, i.e. the dynamic range, is wide. Main restriction factors of the dynamic range are the upper limit of the amount of ions to be mass analyzed and the upper and lower limits of the amount of ions that the ion detector itself can detect.

For example, consider an ion trap time-of-flight mass spectrometer (IT-TOFMS) in which a three-dimensional quadrupole ion trap and a time-of-flight mass spectrometer are combined. A three-dimensional quadrupole ion trap has a relatively low upper limit of the amount of ions that can be stored. In addition, even when the amount of ions is lower than the upper limit, if the amount of ions stored in the ion trap is large, a deterioration of performance, such as the mass resolving power, disadvantageously occurs due to the effect of the interaction among the ions called a space-charge effect. On the other hand, a linear ion trap has a high upper limit of the amount of ions that can be stored compared to three-dimensional quadrupole ion traps. Hence, a use of a linear ion trap in an IT-TOFMS allows a mass analysis of a larger amount of ions, which is advantageous in expanding the dynamic range. After ion optical properties on the ion supply side are improved as just described, what is important in expanding the dynamic range is an improvement of the dynamic range of the ion detector itself.

Examples of ion detectors widely used in a mass spectrometer are as follows: an ion detector using a secondary electron multiplier (refer to Patent Document 1 and other documents); an ion detector using the combination of a conversion dynode and a secondary electron multiplier (refer to Patent Document 2 and other documents); an ion detector using the combination of a conversion dynode, fluorescence substance and a photoelectron multiplier. For example, as disclosed in Patent Document 1 and other documents, in a general secondary electron multiplier, a high voltage provided from a direct-current power supply is resistively divided and applied to multi-stage dynodes for multiplying electrons. The multiplication factor, i.e. the gain of the detector, is changed by controlling the voltage provided from the direct-current power supply.

In a detector using an electron multiplication technology such as a secondary electron multiplier, a photoelectron multiplier, or other unit, the multiplication factor decreases when the input is too much (in particular, when the amount of entering ions is too much), when the voltage applied to dynodes is insufficient, or in other case. This disadvantageously results in saturation of an output signal which is read out from the anode provided in the final stage (which is sometimes called a collector). As methods for resolving such a problem, a boosting method and a dynode readout method are conventionally known.

In the boosting method, the power feeding is not performed by a resistive division but independently performed to each of the dynodes where secondary electrons are multiplied or to one or more dynodes in the posterior portion so that those applied voltages can be adjusted at will. In the dynode readout method, a signal is read out not only from an anode but also from one or more dynodes where electrons are multiplied, However, even with such conventional methods as just described, it is difficult to sufficiently improve the dynamic range. For example, in a TOFMS, a large number of ions continuously enter the ion detector in a very short period of time. In such a case, even if a power is supplied independently to each of the dynodes as in the boosting method, the power feeding amount may transiently run short or a space-charge effect may occur by the electrons inside the secondary electron multiplier, which may lead to a temporary decrease in gain or a rounding of the output waveform. Even in the case where a sufficient power is fed to the dynodes and the space-charge effect of the electrons in the secondary electron multiplier is negligible, in a TOFMS in which a high-speed waveform must be detected, it is necessary to broaden the input band of the amplifier of the detection signal and simultaneously set a high sampling frequency. Consequently, the noise level due to the thermal noise is not negligible, which becomes a restriction factor of the dynamic range.

When a signal is read out from each of the intermediate dynodes or from a specific dynode in a secondary electron multiplier as in the dynode readout method, even in the ease where a decrease in gain or a rounding of waveform occurs in the signal of the anode which is placed in the last stage, the decrease in gain and the rounding of waveform in the intermediate dynodes are relatively small. Therefore, a use of signals of the intermediate dynodes can prevent saturation of the output even when the input is too much.

However, even if there is no longer an excessive input, it is not possible to ensure a sufficient gain for a low-level input immediately after an excessive input, since the secondary electron multiplier requires a certain amount of time to recover from a decrease in gain and a rounding of waveform at each of the dynodes in the posterior portion and the anode. This constitutes a factor of restricting the dynamic range and deteriorating the quantitative capability. Further, in the dynode readout method, it is necessary to process a plurality of signals provided from the secondary electron multiplier. Accordingly, due to the arithmetic computation, the cost of the signal processing unit may be increased. Further, the processing speed may be restricted due to the large amount of computation.

BACKGROUND ART DOCUMENTS

Patent Document

[Patent Document 1] JP-A 2000-357487
[Patent Document 2] WO-A 2007/029327

DISCLOSURE OF THE INVENTION

Problem to be Solved by the Invention

Because of the aforementioned reasons, it is difficult to improve the dynamic range in a conventional electron multiplier detector in the case where it is necessary to detect continuously coming ions with a high time responsiveness, particularly as in a TOFMS. The present invention has been developed in view of such a problem, and the main objective thereof is to improve the dynamic range of a measurement in a mass spectrometer in which an electron multiplier detector is used as an ion detector by preventing signal saturation for an excessive input and rapidly recovering the multiplication factor and a rounding of waveform immediately after the too much input.

Means for Solving the Problem

To solve the aforementioned problem, the first aspect of the present invention provides a mass spectrometer in which an electron multiplier detector having multistage dynodes for sequentially multiplying electrons and an anode for finally detecting electrons multiplied by the dynodes is used as an ion detector, including:

a) a power supplier including at least two direct-current power supplies in which voltages can be independently adjusted so that predetermined voltages are applied to each of the multistage dynodes and the anode;

b) a signal provider for reading out a signal obtained by the anode and for reading out a signal obtained at least one of the multistage dynodes; and c) a signal processor for receiving a plurality of signals read out by the signal provider while voltages are applied to each of the multistage dynodes and the anode by the power supplier and for sequentially selecting one of the plurality of signals to reflect the selected signal in a signal intensity of a mass spectrum.

In the mass spectrometer according to the first aspect of the present invention and the mass spectrometer according to the second aspect of the present invention, which will be described later, the electron multiplier detector may be a secondary electron multiplier detector in which ions are directly introduced to the first dynode. Alternatively, the electron multiplier detector may be a detector configured in a variety of manners, for example: ions may be made to enter a conversion dynode and electrons generated by the conversion dynode are introduced to the secondary electron multiplier; or electrons generated by a conversion dynode are made to collide with a fluorescence substance to be converted into light, and the light is detected by a photoelectron multiplier.

As previously described, in a general electron multiplier detector, a voltage provided from one direct-current power supply is divided by resistive division and the divided voltages are applied to a plurality of dynodes. Since the multiplication factor of electrons in each dynode depends on the applied voltage, if the signal obtained at the anode might be saturated, the applied voltages are decreased by decreasing the output voltage of the direct-current power supply, thereby decreasing the multiplication factor. If, conversely, the signal obtained at the anode might be too small, the applied voltages are increased by increasing the output voltage of the direct-current power supply, thereby increasing the multiplication factor. In general, the multiplication factor of the secondary electron multiplier gradually decreases with a long use clue to time degradation and other factors. Therefore, in order to maintain the same degree of multiplication factor for a long period of time, it is necessary to increase the applied voltages in accordance with the degree of degradation. However, since the voltage division ratio is determined by the resistive division ratio, it is not possible to relatively increase or decrease the multiplication factor of a specific dynode with respect to the other dynodes, although the overall multiplication factor can be increased or decreased.

On the other hand, in the mass spectrometer according to the first aspect of the present invention, for example, a voltage is applied to the final dynode which is placed before the anode from an independent direct-current power supply which is different from the direct-current power supply for multistage dynodes placed before the final dynode. In this case, resistively divided voltages obtained from the output voltage of the direct-current power supply may be applied, as in a conventional manner, to the multistage dynodes before the final dynode. With this configuration, it is possible to determine the voltage applied to the final dynode at will and independently of the voltages applied to the dynodes by resistive division. Therefore, for example, only the multiplication factor of the final dynode can be changed while maintaining the multiplication factor of the anterior dynodes. This can make the saturation of the signal at the final dynode less likely to occur.

Since the amount of electric current which flows through a dynode corresponds to the amount of multiplied electrons, for example, when the amount of incident ions is increased, the amount of electric current which flows to the dynodes particularly in the posterior portion is rapidly increased. While voltages are applied by resistive division, when an electric current flowing in one dynode is rapidly increased and the voltage is temporarily decreased, the voltages applied to the other dynodes are also affected. However, if, in the mass spectrometer acceding to the first aspect of the present invention, a voltage is applied to the final dynode from an independent direct-current power supply for example, even if the electric current flowing in that dynode is rapidly increased, there is no influence on the voltages applied to the other dynodes. In addition, even if the voltage of the final dynode is temporarily decreased, the voltage can be quickly recovered and the multiplication factor can be brought back to the original state.

In addition, in the mass spectrometer according to the first aspect of the present invention, the signal provider reads out not only the signal obtained at the anode but the signal obtained at least one of the multistage dynodes. That is, a plurality of signals are obtained which correspond to the amount of ions which have entered the ion detector at a certain point in time. Receiving the plurality of signals, the signal processor performs a process in which one of the plurality of signals is sequentially selected and reflected in the signal intensity of the mass spectrum. Generally, it is more desirable to use a larger detection signal as long as the signal is not saturated. Hence, it is preferable to determine the possibility of signal saturation based on the obtained signals before selecting one signal.

In particular, for example, the signal processor may include:

a comparison unit for comparing at least one of the plurality of signals with a predetermined threshold; and a selection unit for selecting, based on a result of the comparison, one of the plurality of signals as a signal to be reflected in the signal intensity of the mass spectrum.

However, the multiplication factor of electrons of the signal read out from the anode and that of the signal read out from one or more dynodes are different. In addition, in the case where an amplifier is provided on each signal path, the amplification degree may differ. Further, when analog signals are converted into digital values by analog/digital converters, the full scales of these analog/digital converters may differ. Given these factors, it is necessary to perform a computation for correcting such differences of electron multiplication factors, amplification degrees, full scales, and other values.

The signal processor may temporarily store a plurality of signals (analog value or digital value) for the same kind of incident ions in a memory unit without selecting only one of the signals, and then, in creating a mass spectrum, select one of the obtained signals for each of the different points in time. Alternatively, the processing of selecting one of the signals obtained at each point in time may be performed in storing the signals in the memory unit.

Preferably, the mass spectrometer according to the first aspect of the present invention may further include a controller for adjusting a ratio of output voltages by the two or more direct-current power supplies included in the power supplier in such a manner that a ratio of the plurality of signals read out by the signal provider is a predetermined value.

For example, the predetermined value may be a power of two. In the case where the plurality of signals are converted into digital values by an analog/digital converter and then provided to the signal processor as previously described, the predetermined value may be determined so that a ratio of the digital values corresponding to the signals is a power of two.

As is well known, in digitally performing an arithmetic processing by a signal processor, the computation is generally performed using binary numbers. Hence, if the ratio of a plurality of signals is a power of two and the ratios of electron multiplication factors, amplification degrees, full scales, and other factors corresponding to each signal are also a power of two, the computation for correction as previously described can be accomplished by a simple bit shift operation. This enables high-speed processing, and decreases a rounding error. In many cases, a time-of-flight mass spectrometer requires a high-speed (e.g. several giga samples per second) measurement, and therefore it is important that the data processing is performed at high speed. In addition, in many cases, an A/D converter which can operate at such a high speed has a small number of significant bits, and therefore decreasing the rounding error is important.

In the mass spectrometer according to the first aspect of the present invention, the ratio of plural signals read out by the signal provider is set to be a predetermined value by adjusting the ratio of output voltages from two or more direct-current power supplies which are included in the power supplier. In the case where the ratio of the voltages applied to the dynodes cannot be adjusted, the ratio of the plurality of signals may be modified by adjusting the amplification degree of signal amplifiers provided on signal paths or adjusting the attenuation degree of signal attenuators provided on signal paths.

That is, the second aspect of the present invention provides a mass spectrometer in which an electron multiplier detector having multistage dynodes for sequentially multiplying electrons and an anode for finally detecting electrons multiplied by the dynodes is used as an ion detector, including:

a) a signal provider for reading out a signal obtained by the anode as well as reading out a signal obtained by at least one of the multistage dynodes;

b) a signal adjuster provided on a path of the plurality of signals read out by the signal provider, the signal adjuster being either a signal amplifier or a signal attenuator in which an amplification degree or an attenuation degree is set in such a manner that a ratio of the plurality of signals becomes a predetermined value; and c) a signal processor for receiving a plurality of signals which have passed the signal adjuster and for sequentially selecting one of the plurality of signals to reflect the selected signal in a signal intensity of a mass spectrum.

EFFECTS OF THE INVENTION

In the mass spectrometer according to the first aspect of the present invention, an electric power is supplied from at least two independent power supplies to the multistage dynodes and the anode in the ion detector. Hence, the signals are less likely to be saturated. In addition, even in the case where the signal read out from the anode has undergone saturation or waveform distortion due to the incidence of an excessive amount of ions, the use of signals read out from the dynodes in which ions are under multiplication can prevent the influence of the signal saturation or waveform distortion from appearing on the mass spectrum. Even in the case where signal saturation or waveform distortion occurs as previously described, it is possible to promptly restore the decreased voltage in the dynode or anode in which the signal saturation or waveform distortion has occurred, so that the multiplication factor can be restored. Therefore, even when an excessive amount of ions are injected and then a very small amount of other ions are consequently injected, the secondary electrons corresponding to the very small amount of ions can be appropriately multiplied and can be read out as a detection signal. Hence, with the mass spectrometer according to the first aspect of the present invention, the dynamic range of the signal detection in the ion detector can be expanded more than ever before, which consequently expands the dynamic range of the measurement.

In addition, in the mass spectrometer according to the first aspect of the present invention, the output voltages of two or more independent power supplies can be appropriately adjusted so as to use a simple method for the arithmetic processing of a plurality of signals and thereby increase the processing speed. This alleviates a hardware load in processing signals, allowing a processing with inexpensive hardware.

In the mass spectrometer according to the second aspect of the present invention, even in the case where only one power supply is provided to apply voltages to the multistage dynodes and anode in the ion detector, a simple method for the arithmetic processing of a plurality of signals can be used to increase the processing speed. This alleviates a hardware load in processing signals, allowing a processing with inexpensive hardware.

BEST MODES FOR CARRYING OUT THE INVENTION (First Embodiment)

Figure 1:
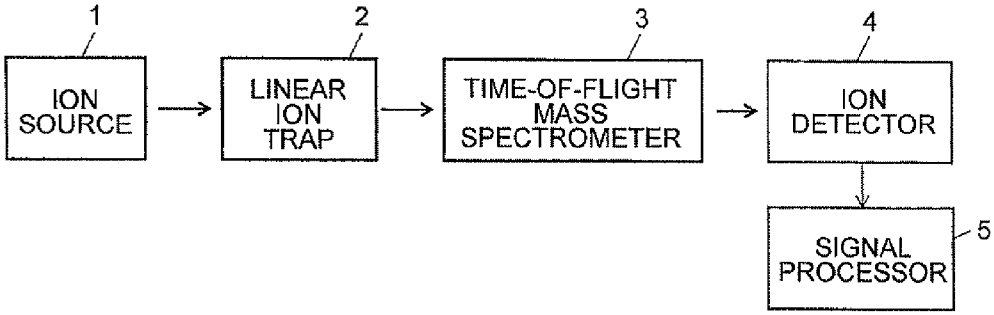
FIG. 1 is a schematic configuration diagram of the mass spectrometer according to the first embodiment of the present invention.

The first embodiment of the mass spectrometer according to the present invention will be described with reference to the attached figures. FIG. 1 is a schematic configuration diagram of the mass spectrometer of the first embodiment.

As shown in FIG. 1, the mass spectrometer of the first embodiment includes: an ion source 1 for ionizing sample molecules; a linear ion trap 2 for temporarily storing ions generated in the ion source 1; a time-of-flight mass spectrometer 3 for temporally separating a variety of ions in accordance with their mass-to-charge ratio m/z which are almost collectively ejected from the linear ion trap 2 at a predetermined timing; and an ion detector 4 for sequentially detecting ions arriving at the detector in a temporally separated form. These components are placed in a container (not shown) which is maintained at a vacuum atmosphere.

The signal detected by the ion detector 4 is sent to the signal processing unit 5, where a predetermined signal processing is performed so as to create a mass spectrum in which the mass is assigned to the horizontal axis and the signal intensity to the vertical axis. Further, in the signal processing unit 5, a qualitative analysis or a quantitative analysis is performed by analyzing the mass spectrum. The ionization method by the ion source 1 is not particularly limited. For example, a matrix assisted laser desorption ionization (MALDI) method can be used. In addition, in place of the linear ion trap 2, a three-dimensional quadrupole ion trap may be used.

Figure 2:
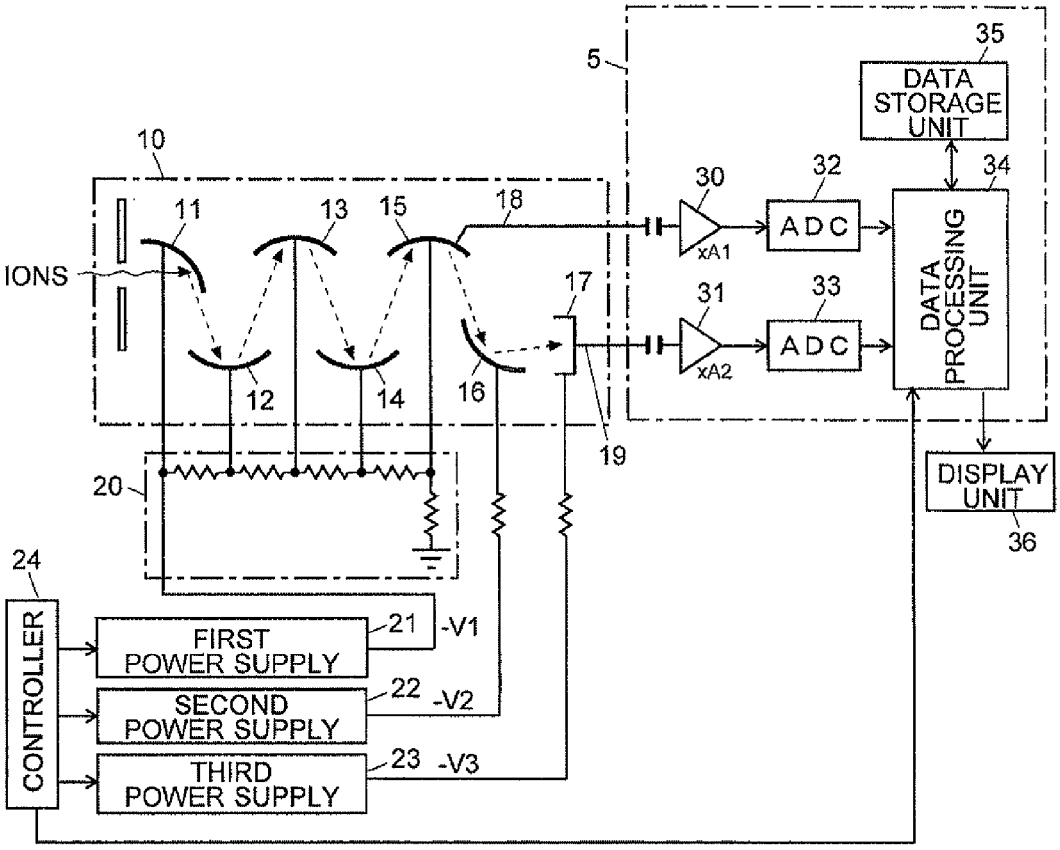
FIG. 2 is a configuration diagram showing the main components of the ion detector and signal processing unit in the mass spectrometer of the first embodiment.

FIG. 2 is a configuration diagram showing the main components of the ion detector 4 and the signal processing unit 5 in the mass spectrometer of the first embodiment. As the ion detector 4, a secondary electron multiplier 10 is used. The ions separated in the time-of-flight mass spectrometer 3 are directly introduced into the secondary electron multiplier 10. As shown in FIG. 2, the secondary electron multiplier 10 includes multistage (six stages in this example; however, generally about a dozen to twenty stages) dynodes 11 through 16 for sequentially multiplying electrons, and an anode (collector) 17 for finally detecting the electrons multiplied by the dynodes 11 through 16.

A negative direct-current high voltage −V1 provided from the first power supply 21 is divided through a division resistive network 20 and provided to each of the first through fifth dynodes 11 through 15. A negative voltage −V2 provided from the second power supply 22 is applied to the final dynode 16, and a negative (or at the ground potential) voltage −V3 provided from the third power supply 23 is applied to the anode 17. That is, power supplies capable of adjusting the voltage are provided for the anode 17 and the final dynode 16, independently of the power supply for the first through fifth dynodes 11 through 15, which are placed anterior to the anode 17 and the final dynode 16. These power supplies 21 through 23 correspond to the power supplier of the present invention.

In the secondary electron multiplier 10, a signal line 19 is drawn from the anode 17 for finally detecting electrons, and a signal line 18 is drawn from the fifth dynode 15. These two signal lines 18 and 19, which correspond to the signal provider of the present invention, are connected to preamplifiers 30 and 31 each via a capacitor for interrupting a direct-current in the signal processing unit 5. The outputs from the preamplifiers 30 and 31 are provided to analog/digital convertors (ADC) 32 and 33 in parallel, where the outputs are sampled at predetermined timings and converted into digital values, which are sent as detection data to the data processing unit 34. A data storage unit 35 for storing the detection data is attached to the data processing unit 34. The data processing unit 34 stores necessary detection data in the data storage unit 35 and performs a data processing which will be described later to create a mass spectrum. The output voltages of the first through third power supplies 21 through 23 are controlled by the control unit 24. The operation of the data processing unit 34 is also controlled by the control unit 24.

Next, the ion detection operation in the ion detector 4 and the signal processing unit 5 will be described.

The control unit 24 sets a target voltage for each of the first through third power supplies 21 through 23, and the first through third power supplies 21 through 23 respectively regulate the output voltages V1 through V3 so that they become the set target voltages. Voltages obtained by resistively dividing the voltage −V1 in the division resistive network 20 are applied to the first through fifth dynodes 11 through 15 of the secondary electron multiplier 10. Hence, the voltages are determined by the resistance ratio, and the voltage ratio is also uniquely determined. On the other hand, since voltages are independently applied to the final dynode 16 and to the anode 17, these voltages can be determined at will. In this example, as will be described later, the voltages −V1, −V2, and −V3 are determined in such a manner that the ratio of the detection data corresponding to the two-channel signals is a power of two, e.g. $2^0:2^3$. The relationship between the applied voltage and the multiplication factor in the secondary electron multiplier 10 gradually changes due to contamination on the dynodes and other factors. Hence, for example, in the measurement of a standard sample, a kind of correction may be performed in such a manner that the control unit 24 may receive feedback of the detection data from the data processing unit 34 and then adjust the output voltages so that the ratio of the detection data becomes a power of two.

When a mass analysis is started by introducing a sample into the ion source 1, the secondary electron multiplier 10 operates under the aforementioned voltage application conditions, and two-channel detection signals corresponding to the number of incident ions are concurrently provided through the signal lines 18 and 19. The detection signal obtained in the fifth dynode 15 in correspondence to the ions that have entered the secondary electron multiplier 10 at a certain point in time, i.e. the signal (analog value) read out through the signal line 18, is called P1 for convenience. Likewise, the detection signal obtained in the anode 17, i.e. the signal (analog value) read out through the signal line 19 is called P2. The two signals naturally satisfy P1<P2. The signal P1 is amplified at an amplification degree of A1 in the preamplifier 30 and then converted into a digital value in the ADC 32. The signal P2 is amplified at an amplification degree of A2 in the preamplifier 31 and then converted into a digital value in the ADC 33. For the sake of convenience, the digital value corresponding to the signal P1 is called detection data D1, and that corresponding to the signal P2 is called detection data D2. The data processing unit 34 acquires the detection data concurrently obtained in the two ADCs 32 and 33, and stores the detection data in the data storage unit 35 in accordance with their acquisition time (or simply in chronological order).

If too many ions having the same mass-to-charge ratio enter the secondary electron multiplier 10, an electric current by secondary electrons may not sufficiently flow in some of the dynodes in the posterior portion, such as the final dynode 16 and the anode 17, resulting in signal saturation or a distortion of the signal waveform. In this case, even if the signal P2 is saturated for example, there is the least possibility that the signal P1 read out from the anterior dynode, i.e. the fifth dynode 15, having a low multiplication factor is saturated. Therefore, even in the case where an excessive number of ions have entered the secondary electron multiplier 10, at least one of the two obtained detection data D1 and D2 which are stored in the data storage unit 35 for the same point in time does not have signal saturation and waveform distortion.

One of the reasons why the signal saturation occurs is as follows: since the amount of electric current corresponding to the amount of secondary electrons flows in a dynode, when the amount of secondary electrons is excessive, the power supply can no longer provide a sufficient electric current for it. In the case where voltages are applied to each dynode by resistive division, it is difficult to promptly respond to a sudden increase of electric current. Furthermore, its influence may spread through the resistor network and cause a temporary decrease in the voltage applied to a dynode in which no signal saturation is occurring. On the other hand, in the mass spectrometer of the first embodiment, voltages are applied to the final dynode 16 and to the anode 17 from the power supplies independent of a power supply for the first through fifth dynodes 11 through 15. Therefore, even in the case where the electric current by secondary electrons is suddenly increased, it is possible to promptly respond to it, preventing a decrease of the electron multiplication factor. In addition, even if the electron multiplication factor is temporarily decreased, it can be promptly restored. Hence, signal saturation or waveform deformation itself is not likely to occur, and even if such a state temporarily occurs, the signal can immediately return to the original normal state. Consequently, it is possible to obtain signals corresponding to the subsequently coming ions.

In the data processing unit 34, while a measurement is performed (while the detection data are being acquired) or after a measurement is performed (after all the detection data are acquired), a mass spectrum is created based on an instruction of the analysis operator, and the mass spectrum is displayed on a window of the display unit 36. For example, when a mass spectrum is created and displayed after a measurement is finished (i.e. offline), the data processing unit 34 reads out the detection data from the data storage unit 35 in the order of lapse of time in the measurement. As previously described, there are two pieces of data D1 and D2 for each point in time. Hence, a signal intensity value which should be reflected in the mass spectrum at that point in time is obtained as in the following manner.

That is, whether the value of the detection data D1 is equal to or less than a predetermined threshold Dt is first determined. If D1≦Dt, the detection data D2 is used, and if D1>Dt, the detection data D1 is used. This is because, if D1≦Dt, D2, which is larger than D1, is unlikely to be saturated, and D1 has the lower S/N ratio due to its small value. On the other hand, if D1>Dt, D1 is used because it is probable that D2 is saturated. In this manner, from the two detection data D1 and D2, it is possible to select the detection data in which no signal saturation has occurred and which has the S/N ratio as high as possible. By performing the determination operation as just described to two detection data for each point in time, a set of detection data which should be reflected in the mass spectrum is selected.

Another similar method is possible. That is, whether the value of the detection data D2 is equal to or more than a predetermined threshold Dt' is determined. If D2≧Dt', the detection data D1 is used, and if D2<Dt', the detection data D2 is used. With this method, it is also possible to use a set of detection data in which no signal saturation has occurred and which has the S/N ratio as high as possible.

The detection data D1 are based on the signal P1 which is read out from the fifth dynode 15 having a multiplication factor lower than that of the anode 17. Hence, in order to use the detection data D1 in place of D2, it is necessary to correct the level due to the difference of the electron multiplication factors or other reason. If the amplification degrees A1 and A2 of the preamplifiers 30 and 31 are the same (A1=A2) and the full scales (gains) of the ADC 32 and 33 are also the same, the level only needs be corrected by an amount corresponding to the difference of the electron multiplication factors in the secondary electron multiplier 10. In this case, the value of the detection data D1 is corrected by using the following formula (1):

$$D1'=D1\times\{(\text{the multiplication factor of the anode 17})/(\text{the multiplication factor of the fifth dynode 15})\} \quad (1).$$

The multiplication factor of the anode 17 and that of the fifth dynode 15 are determined by the voltages applied to the dynodes 11 through 16. Hence, in performing a measurement, the data processing unit 34 can receive the target value data of the application voltages from the control unit 24, compute the multiplication factors based on the target value data, map them to the detection data, and store the result in the data storage unit 35.

In the case where the amplification degrees Al and A2 of the preamplifiers 30 and 31 are not the same, and/or where the full scales of the ADC 32 and 33 are not the same, the value of the detection data D1 can be corrected by the following formula (2), in place of the formula (1):

$$D1'=D1\times\{(\text{the multiplication factor of the anode 17})\times[(\text{the amplification degree } A2 \text{ of the preamplifier 31})/(\text{the full scale of the } ADC\ 33)]\}/\{(\text{the multiplication factor of the fifth dynode 15})\times[(\text{the amplification degree } A1 \text{ of the preamplifier 30})/(\text{the full scale of the } ADC\ 32)]\} \quad (2).$$

In performing a computation with the formula (1) or formula (2) in the data processing unit 34, the processing is generally performed in binary. Therefore, if the ratio of each element of these formulae is an integral ratio, there is no need to perform a computation with decimals. In addition, if the ratio is a power of two, a multiplication and division can be performed by only a bit shift operation. Since a bit shift processing can be performed very quickly, a correction of two or more pieces of detection data can also be performed very quickly. Consequently, for example, in the case where the computation processing is performed by a central processing unit (CPU), the CPU load will be alleviated, and in the case where the computation processing is performed by hardware such as a digital signal processor (DSP), the amount of hardware can be decreased.

In the data processing unit 34, for two detection data D1 and D2 obtained at the same point in time, the selection of the detection data and a level correction (if necessary) as previously described are performed to sequentially create the data to be eventually reflected in the mass spectrum, and create a time-of-flight mass spectrum from these data. Then, based on previously obtained calibration information which shows the relationship between the time of flight and the mass-to-charge ratio, a mass spectrum is created by converting the time of flight into the mass-to-charge ratio. Then, the mass spectrum is displayed on a window of the display unit 36. The mass spectrum created and displayed in this manner is free from the influence of signal saturation and waveform distortion which occurs when a large amount of ions reach the ion detector 4. Furthermore, this mass spectrum has a high S/N ratio and reflects accurate signal values even when the amount of ions arriving at the ion detector 4 is small.

In the mass spectrometer of the first embodiment, both the A/D conversion values (detection data) D1 and D2 of the signals P1 and P2 are stored in the data storage unit 35, and when an operation of creating a mass spectrum is performed online or offline, either one of the detection data D1 and D2, which were obtained at the same point in time, are selected and level-corrected. The advantage of this method is that the ratio of the electron multiplication factors and other values do not have to be previously known. In the meantime, the two signals P1 and P2 or the detection signals D1 and D2 can be handled as in the following modification examples.

MODIFICATION EXAMPLE 1

When a sample is measured to obtain mass spectrum data, one of the two detection data D1 and D2 obtained for the same point in time are selected as in the aforementioned manner, and only the selected data are stored in the data storage unit 35. Information (e.g. a one-bit flag) for indicating which of the detection data D1 and D2 have been selected is added, and if a mass spectrum is created and displayed offline, the added information is used to determine whether to perform a level correction, then a level correction is performed if necessary. The advantage of this method is that the required amount of data stored in the data storage unit 35 is merely about one half of the amount in the aforementioned method.

MODIFICATION EXAMPLE 2

When a sample is measured to obtain mass spectrum data, one of the two detection data D1 and D2 obtained for the same point in time are selected as in the aforementioned manner. When the detection data D1 are selected, they are level-corrected and then stored in the data storage unit 35. In this case, only one piece of data is memorized for one point in time. Hence, in creating and displaying a mass spectrum offline, a time-of-flight spectrum can be easily created by reading out the detection data from the data storage unit 35.

MODIFICATION EXAMPLE 3

To the data obtained by level-correcting the selected detection data according to necessity as in Modification Example 2, a lossy compression, such as a logarithmic operation followed by expressing the result as an integer, or a lossless compression is performed to decrease the amount of data and then the result is stored in the data storage unit 35. In this case, the higher the compression rate is, the smaller the amount of data is. However, if a lossy compression is performed, a small difference occurring in a large signal is not reflected in the result. On the other hand, a lossless compression generally requires a long arithmetic processing time.

MODIFICATION EXAMPLE 4

All the aforementioned methods are aimed at creating and displaying a mass spectrum in which the waveform of each peak, i.e. not only the peak top but also the slope of the peak, is reflected. On the other hand, when it is only necessary to create and display a mass spectrum in which each peak is drawn with a simple line indicating only the signal value of the peak top, it is not necessary to store all the detection data for each sampling time: only the appearance time and the peak value of the peak top of each peak detected by a previously performed peak detection may be stored in the data storage unit 35. In this case, the amount of data to be stored is significantly reduced.

In the above explanation, it is presumed that two detection data D1 and D2 are obtained at the same point in time. However, in the inside of the secondary electron multiplier 10, electrons which are multiplied in accordance with incident ions first arrive at the fifth dynode 15, and then arrive at the anode 17. Therefore, the points in time when the signals P1 and P2 are obtained are different, albeit only slightly. Further, the rise times and the fall times of the signals P1 and P2 are different, albeit only slightly, due to the difference between the electrode capacitance of the fifth dynode 15 and that of the anode 17, the difference of the temporal spread of incoming electron groups, and other factors. In a time-of-flight mass spectrometer, a time lag leads to a shift of the mass-to-charge ratio. Hence, in order to further enhance the mass resolution and mass accuracy, the following operation can be added with the aim of resolving the time lag as described above.

That is, when the time difference between the signals P1 and P2 is a problem, a delay element may be disposed, for example, in the signal line 18 on an analog circuit to delay the signal P1 and thereby correct the time difference. Alternatively, a correction processing may be performed in which the sampling time in the ADC 33 may be slightly delayed with respect to the sampling time in the ADC 32. When the difference in the rise time and fall time between the signals P1 and P2 is a problem, a waveform shaping circuit may be provided in an analog circuit. Alternatively, a waveform shaping may be digitally performed after an AID conversion. In the case where a waveform is not shown but only peak values are shown on a mass spectrum as in the Modification Example 4, the difference in the rise time and fall time of the signals cannot be a problem.

(Second Embodiment)

Figure 3:
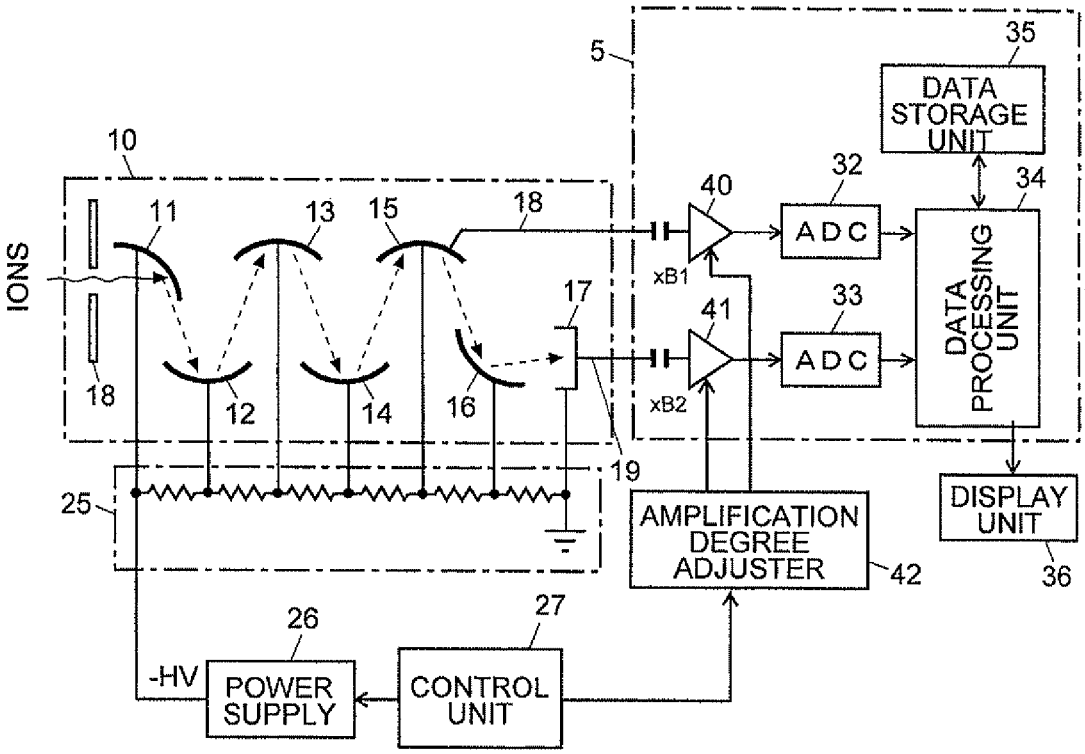
FIG. 3 is a configuration diagram showing the main components of the ion detector and signal processing unit in the mass spectrometer according to the second embodiment of the present invention.

Next, a mass spectrometer according to another embodiment (second embodiment) of the present invention will be described. The overall configuration of this mass spectrometer is the same as that of the first embodiment. The configuration and operation of the ion detector 4 and the signal processing unit 5 are different from those of the first embodiment. FIG. 3 is a configuration diagram showing the main components of the ion detector 4 and the signal processing unit 5 in the mass spectrometer according to the second embodiment. The same configuration elements as in the first embodiment are indicated with the same numerals and the explanations are omitted.

In this second embodiment, the output voltage −HY of the sole power supply 26 is divided by the division resistive network 25. The divided voltages are applied to the dynodes 11 through 16 of the secondary electron multiplier 10. The anode 17 is grounded. Therefore, the stabilization effect of the voltage and electric current and other effects by independently providing power supplies for applying a voltage to the final dynode 16 and the anode 17 cannot be achieved as in the first embodiment. However, in the case where an excessive amount of ions enter the ion detector 4 and saturation and waveform distortion occur in the signal read out from the anode 17, as in the first embodiment, the signal read out from the dynodes by which ions are multiplied may be used to prevent the effects of the signal saturation and waveform distortion from appearing on the mass spectrum.

Both the preamplifier 40 provided in the signal line 18 and the preamplifier 41 provided in the signal line 19 are an amplification-degree-variable amplifier. Each of the amplification degrees of the preamplifiers 40 and 41 is set at a predetermined value by the amplification degree controller 42. In the mass spectrometer of the first embodiment, the ratio of the detection data D1 and D2 is set to be a power of two by appropriately adjusting the output voltages of the power supplies 21 through 23. On the other hand, in the mass spectrometer of the second embodiment, the ratio of the detection data D1 and D2 is set to be a power of two by appropriately setting the amplification degrees of the preamplifiers 40 and 42 by the amplification degree controller 42. The reason why the ratio of the detection data D1 and D2 is preferably set to be a power of two is because, also in the second embodiment, a correction computation of the aforementioned formula (2) can be performed by a high-speed bit shift processing in the data processing unit 34. If the correction computation is performed by a CPU, the CPU load is alleviated, and if it is performed by hardware such as a DSP, the amount of hardware can be decreased.

In the configuration of FIG. 3, the amplification degree is variable in both the preamplifiers 40 and 41. However, the amplification degree may be fixed in one preamplifier and the amplification degree may be variable in the other preamplifier. Alternatively, instead of using amplification-degree-variable amplifiers 40 and 41, a signal attenuator with a variable attenuation factor may be inserted. Or, the full scales of the ADCs may be variable so that the ratio of the detection data can be adjusted by controlling the full scales.

It should be noted that the embodiments described thus far are mere examples of the present invention, and it is evident that any modification, adjustment, or addition made within the sprit of the present invention is also included in the scope of the claims of the present application.

EXPLANATION OF NUMERALS

1 . . . Ion Source
2 . . . Linear Ion Trap
4 . . . Ion Detector
5 . . . Time-Of-Flight Mass Spectrometer
10 . . . Secondary Electron Multiplier
11 through 16 . . . Dynode
17 . . . Anode
18 and 19 . . . Signal Line
20 . . . Division Resistive Network
21 through 23, and 26 . . . Power Supply
24 and 27 . . . Control Unit
30, 31, 40, and 41 . . . Preamplifier
32 and 33 . . . Analog/Digital Converter (ADC)
34 . . . Data Processing Unit
35 . . . Data Storage Unit
36 . . . Display Unit
42 . . . Amplification Degree Controller

The invention claimed is:

1. A mass spectrometer in which an electron multiplier detector having multistage dynodes for sequentially multiplying electrons and an anode for finally detecting electrons multiplied by the dynodes is used as an ion detector, comprising:

a) a power supplier including at least two direct-current power supplies in which voltages can be independently adjusted so that predetermined voltages are applied to each of the multistage dynodes and the anode;

b) a signal provider for reading out a signal obtained by the anode and for reading out a signal obtained at least one of the multistage dynodes; and c) a signal processor for receiving a plurality of signals read out by the signal provider while voltages are applied to each of the multistage dynodes and the anode by the power supplier and for sequentially selecting one of the plurality of signals to reflect the selected signal in a signal intensity of a mass spectrum.

2. The mass spectrometer according to claim 1, further comprising:

a controller for adjusting a ratio of output voltages by the two or more direct-current power supplies included in the power supplier in such a manner that a ratio of the plurality of signals read out by the signal provider is a predetermined value.

3. The mass spectrometer according to claim 2, wherein the predetermined value is a power of two.

4. The mass spectrometer according to claim 3, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

5. The mass spectrometer according to claim 2, wherein:

the plurality of signals are converted into digital values by an analog/digital converter and then provided to the signal processor; and the predetermined value is determined so that a ratio of the digital values corresponding to the signals is a power of two.

6. The mass spectrometer according to claim 5, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

7. The mass spectrometer according to claim 2, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

8. The mass spectrometer according to claim 1, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

9. A mass spectrometer in which an electron multiplier detector having multistage dynodes for sequentially multiplying electrons and an anode for finally detecting electrons multiplied by the dynodes is used as an ion detector, comprising:

a) a signal provider for reading out a signal obtained by the anode as well as reading out a signal obtained by at least one of the multistage dynodes;

b) a signal adjuster placed on a path of the plurality of signals read out by the signal provider, the signal adjuster being either a signal amplifier or a signal attenuator in which an amplification degree or an attenuation degree is set in such a manner that a ratio of the plurality of signals becomes a predetermined value; and c) a signal processor for receiving a plurality of signals which have passed the signal adjuster and for sequentially selecting one of the plurality of signals to reflect the selected signal in a signal intensity of a mass spectrum.

10. The mass spectrometer according to claim 9, wherein the predetermined value is a power of two.

11. The mass spectrometer according to claim 10, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

12. The mass spectrometer according to claim 9, wherein:

the plurality of signals are converted into digital values by an analog/digital converter and then provided to the signal processor; and the predetermined value is determined so that a ratio of the digital values corresponding to the signals is a power of two.

13. The mass spectrometer according to claim 12, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

14. The mass spectrometer according to claim 9, wherein the signal processor includes:

a comparison unit for comparing at least one of the plurality of signals with a predetermined threshold; and a selection unit for selecting, based on a result of the comparison, one of the plurality of signals as a signal to be reflected in the signal intensity of the mass spectrum.

* * * * *